US008061990B1

(12) United States Patent
Ryznic

(10) Patent No.: US 8,061,990 B1
(45) Date of Patent: Nov. 22, 2011

(54) TURBINE ROTOR BLADE WITH LOW COOLING FLOW

(75) Inventor: John E Ryznic, Palm Beach Gardens, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 432 days.

(21) Appl. No.: 12/404,049

(22) Filed: Mar. 13, 2009

(51) Int. Cl.
*F01D 5/08* (2006.01)

(52) U.S. Cl. ..... 416/97 R; 416/96 A; 416/96 R; 416/97 A; 416/228; 415/115; 415/116

(58) Field of Classification Search ..... 415/115, 415/116, 173.1, 173.4; 416/1, 92, 95, 96 A, 416/96 R, 97 A, 97 R, 228
See application file for complete search history.

(56) References Cited

U.S. PATENT DOCUMENTS

| | | | | |
|---|---|---|---|---|
| 5,681,144 | A * | 10/1997 | Spring et al. | 416/97 R |
| 6,206,638 | B1 * | 3/2001 | Glynn et al. | 416/97 R |
| 6,224,336 | B1 * | 5/2001 | Kercher | 416/97 R |
| 6,607,356 | B2 * | 8/2003 | Manning et al. | 416/97 R |
| 6,832,889 | B1 * | 12/2004 | Lee et al. | 415/115 |
| 6,890,153 | B2 * | 5/2005 | Demers et al. | 416/97 R |
| 6,984,103 | B2 * | 1/2006 | Lee et al. | 415/115 |
| 7,293,961 | B2 * | 11/2007 | Lee et al. | 416/96 R |
| 7,296,973 | B2 * | 11/2007 | Lee et al. | 416/97 R |
| 7,527,474 | B1 * | 5/2009 | Liang | 416/1 |
| 7,607,893 | B2 * | 10/2009 | Lee et al. | 416/228 |
| 7,901,181 | B1 * | 3/2011 | Liang | 416/97 R |
| 2004/0219016 | A1 * | 11/2004 | Demers et al. | 416/97 R |
| 2005/0111976 | A1 * | 5/2005 | Lee | 416/97 R |
| 2005/0169752 | A1 * | 8/2005 | Lee et al. | 416/97 R |
| 2005/0226726 | A1 * | 10/2005 | Lee et al. | 416/97 R |
| 2006/0051208 | A1 * | 3/2006 | Lee et al. | 416/97 R |
| 2007/0128034 | A1 * | 6/2007 | Lee et al. | 416/97 R |

* cited by examiner

*Primary Examiner* — Michael Lebentritt
(74) *Attorney, Agent, or Firm* — John Ryznic

(57) ABSTRACT

A turbine rotor blade with a series of 3-pass serpentine flow near wall cooling circuits that extend along the airfoil to provide low flow cooling for the blade. the 3-pass serpentine circuits include a first channel positioned along the pressure side wall to provide near wall cooling, a third channel positioned along the suction side wall to provide near wall cooling, and a second or middle channel located between the two near wall channels in the cooler section of the airfoil. The two near wall radial extending cooling channels flow in a direction toward the blade tip so that the centrifugal force developed due to blade rotation will aid in driving the flow while the second channel is without trip strips and has a larger flow area to minimize flow loss. The first channel with cooler air provides near wall cooling to the hotter sections of the airfoil while the third channel uses the heated air to provide cooling to the cooler sections of the airfoil.

14 Claims, 2 Drawing Sheets

View A-A

View A-A

TURBINE ROTOR BLADE WITH LOW COOLING FLOW

FEDERAL RESEARCH STATEMENT

None.

CROSS-REFERENCE TO RELATED APPLICATIONS

None.

BACKGROUND OF THE INVENTION

1. Field of the Invention

The present invention relates generally to a gas turbine engine, and more specifically to a turbine rotor blade with low cooling air flow.

2. Description of the Related Art Including Information Disclosed Under 37 CFR 1.97 and 1.98

In a gas turbine engine, a hot gas flow is passed through a turbine to extract mechanical energy used to drive the compressor or a bypass fan. The turbine typically includes a number of stages to gradually reduce the temperature and the pressure of the flow passing through. One way of increasing the efficiency of the engine is to increase the temperature of the gas flow entering the turbine. However, the highest temperature allowable is dependent upon the material characteristics and the cooling capabilities of the airfoils, especially the first stage stator vanes and rotor blades. Providing for higher temperature resistant materials or improved airfoil cooling will allow for higher turbine inlet temperatures.

Another way of increasing the engine efficiency is to make better use of the cooling air used that is used to cool the airfoils. A typical air cooled airfoil, such as a stator vane or a rotor blade, uses compressed air that is bled off from the compressor. Since this bleed off air is not used for power production, airfoil designers try to minimize the amount of bleed off air used for the airfoil cooling while maximizing the amount of cooling produced by the bleed off air.

In the industrial gas turbine engine (IGT), high turbine inlet temperatures are envisioned while using low cooling flows. The low cooling flows pass the compressed cooling air through the airfoils without discharging film cooling air out through the airfoil surface and into the hot gas flow or discharging a very minimal amount out through the blade tip or the leading edge region. IGT engines of the future will have higher firing temperatures which mean higher turbine inlet temperatures. With a higher turbine inlet temperature, the latter stage turbine blades that do not require internal cooling will require internal cooling to prevent erosion damage because these latter stage blades will be exposed to higher temperature gas flows. Thus, there is a need for an improvement in the design of low flow cooling circuits for airfoils exposed to higher gas flow temperatures.

BRIEF SUMMARY OF THE INVENTION

It is an object of the present invention to provide for an air cooled turbine blade that operates at high firing temperature and with low cooling flow.

Another object of the present invention to provide for an air cooled turbine blade in which individual impingement cooling circuits can be independently designed based on the local heat load and aerodynamic pressure loading conditions around the airfoil.

Another object of the present invention to provide for an air cooled turbine blade with multiple use of the cooling air to provide higher overall cooling effectiveness levels.

Another object of the present invention to provide for an air cooled turbine blade with in which the centrifugal forces developed by the rotation of the blade will aid in forcing the cooling air through the blade cooling passages.

The above objectives and more are achieved with the turbine rotor blade of the present invention that includes a number of radial extending near wall cooling channels positioned along the pressure side wall and the suction side wall to provide near wall cooling for the airfoil walls, and a collector cavity located between the pressure side radial near wall cooling channel and the suction side radial near wall cooling channel so form a 3-pass serpentine flow cooling circuit to cool the pressure side wall first and then the suction side wall after. The second leg of the 3-pass serpentine flow cooling circuit has a larger cross sectional area that the two near wall radial channels and is without trip strips so that less resistance to flow occurs. Being located between the two radial near wall channels also allows for the cooling flow to flow from tip to platform so that the two radial near wall channels flows from platform to tip in which the cooling air flow is aided by the centrifugal force due to rotor blade rotation.

A number of separate 3-pass serpentine near wall cooling circuits are positioned along the airfoil in a chordwise direction and each can be separately design for cooling air flow to provide selective cooling to that portion of the airfoil in order to regulate the metal temperature of the airfoil. Hotter sections of the airfoil can have more cooling air flow or surface area to provide enough cooling. Also, since the pressure side wall is cooled first and then the same cooling air is used to provide cooling for the suction side wall, less cooling air is required to cool the entire airfoil.

DETAILED DESCRIPTION OF THE INVENTION

The present invention is a near wall multiple impingement serpentine flow cooling circuit used in a rotor blade of a gas turbine engine. In a large industrial gas turbine engine with a high firing temperature, airfoils such as rotor blades can have a relatively thick TBC to provide added thermal protection. With such a rotor blade having a thicker TBC, low flow cooling for the interior can be used which increases the engine performance by using less cooling air. The low flow cooling is produced by reducing or eliminating the use of film cooling on the airfoil walls by discharging a layer of film cooling air through rows of holes opening onto the airfoil wall surface on the pressure side and the suction side. The present invention makes use of radial cooling channels extending along the pressure and the suction side walls of the blade to produce near wall cooling without the use of film cooling holes. The cooling air is discharged from the passages through blade tip holes. Thus, the cooling air remains within the cooling passages to minimize the amount of cooling air used in order to provide for a low flow cooling capability. The use of the multiple metering holes in the channels having cooling flow from root to tip will significantly increase the near wall cooling capability of the cooling flow while the use of the unobstructed return passages (by unobstructed I mean without metering holes) minimizes the pressure loss in the cooling flow. Trips strips could be used in the return passages if the pressure loss is not critical. Multiple channels are used in the cooling passages to provide near wall cooling to the blade walls.

Figure 1:
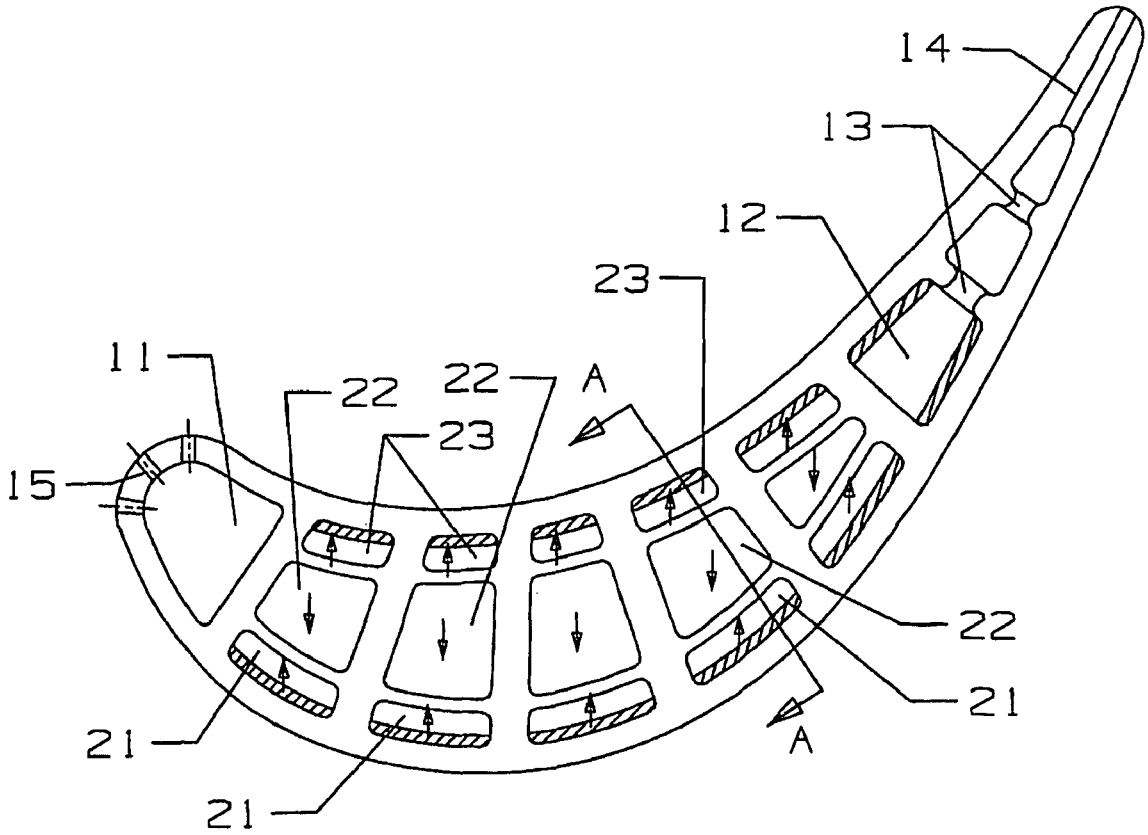
FIG. 1 shows a cross section top view of the 3-pass serpentine flow near wall cooling circuits for the turbine rotor blade of the present invention.

FIG. 1 shows a cross section top view of the cooling circuit of the present invention. The airfoil includes a leading edge showerhead 15 arrangement for discharging film cooling air onto the leading edge. The airfoil also includes a trailing edge section with multiple impingement 13 followed by discharge of the cooling air through exit holes or exit slots 14 arranged along the trailing edge or on the side wall adjacent to the trailing edge. The leading edge region can include a leading edge cooling air supply channel connected to a leading edge impingement cavity through a row of metering and impingement holes, where the showerhead film holes are connected to the leading edge impingement cavity 11. The trailing edge cooling circuit is supplied by a trailing edge cooling supply channel 12.

The main part of the invention is in the 3-pass serpentine flow circuits that provide near wall cooling to the pressure and suction side walls between the leading edge and the trailing edge region. A series of chordwise extending 3-pass serpentine circuits are formed and each one includes a radial extending near wall cooling channel 21 on the pressure side wall with trip strips and a radial extending near wall cooling channel 23 on the suction side wall with trip strips to provide near wall cooling for the two walls. Positioned between the two radial near wall channels is a collector cavity or channel 22 that connects the radial channel 21 on the pressure side to the radial channel 23 on the suction side to form the 3-pass serpentine flow cooling circuit.

Figure 2:
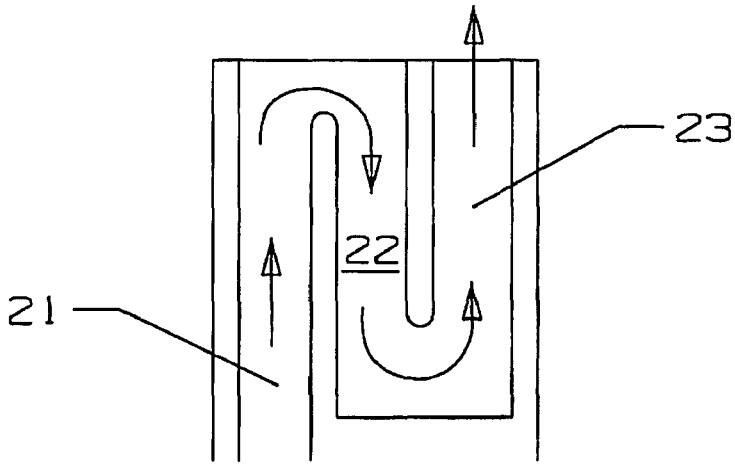
FIG. 2 shows a cross section view of a single 3-pass serpentine flow circuit used in the present invention taken along line A-A in FIG. 1.
Figure 3:
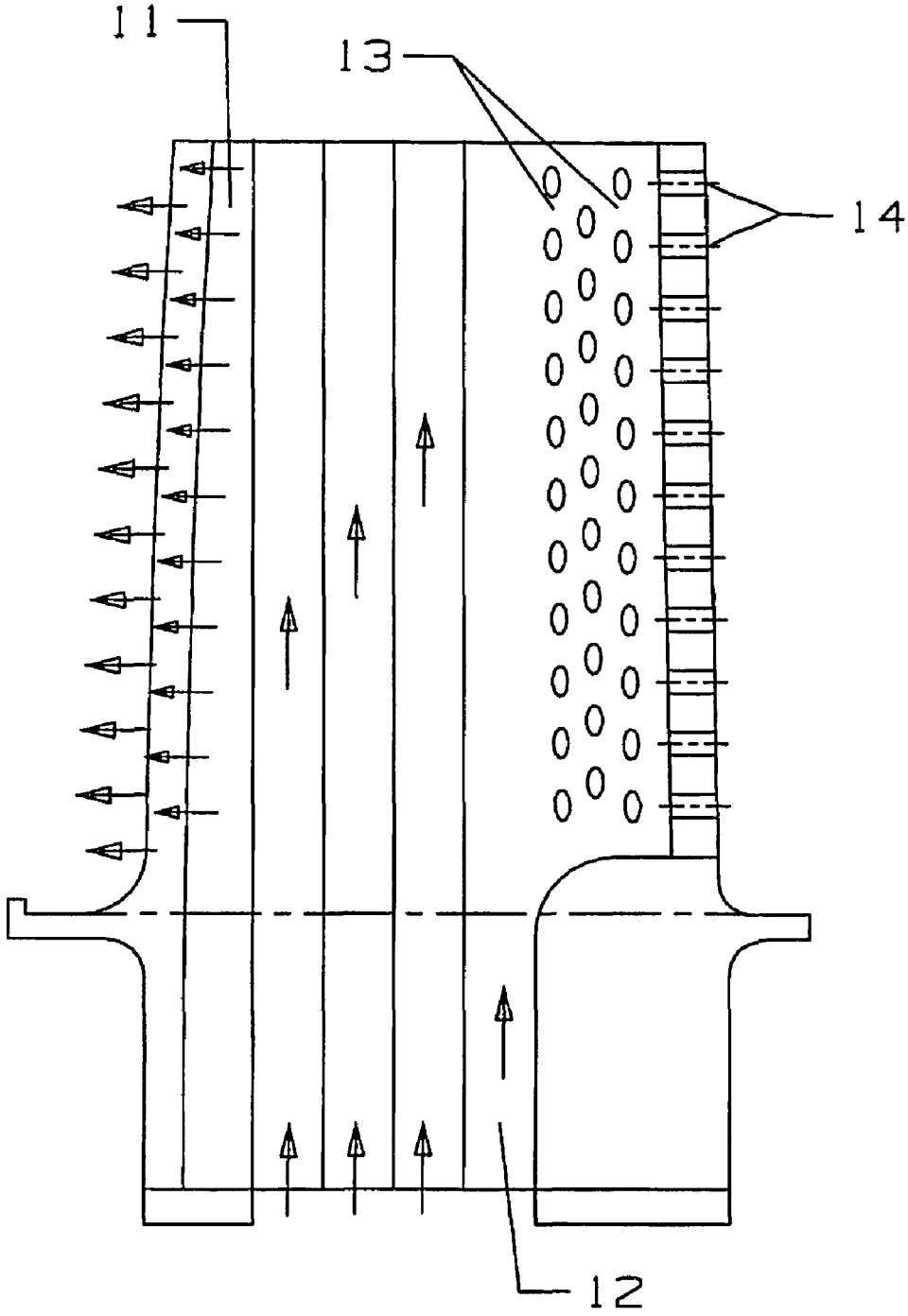
FIG. 3 shows a cross section side view of the cooling circuit of the present invention through a chordwise center line.

The 3-pass serpentines flow circuits thus include a first leg of channel 21 along the pressure side wall, the second leg 22 in the middle region of the airfoil away from both walls, and the third leg or channel 23 along the suction side wall as best seen in FIG. 2. The first leg 21 and third leg 23 both flow from platform toward the tip so the cooling air flow is aided by the centrifugal forces developed due to rotation of the rotor blade. The two near wall radial flowing channels 21 and 23 also include trip strips along the hot wall sections to promote heat transfer. The middle or second leg or channel 22 is located in the middle where the airfoil is cooler and is larger in flow area that the two near wall channels and without trip strips so that the flow restriction is minimized.

With this design, the separate 3-pass radial flow near wall cooling circuits can be designed to provide a certain amount of cooling air flow depending upon the cooling requirements for that region of the airfoil. Also, because the first leg of the 3-pass serpentine is arranged along the pressure side wall—which is the hottest airfoil surface—this airfoil section receives the coolest temperature air. The heated air from the pressure side wall is then passed along the relatively cooler suction side wall to provide additional cooling here. Each 3-pass serpentine flow circuit can be designed with different flow areas depending upon the cooling flow and desired metal temperature.

In another embodiment, one or more of the 3-pass serpentine flow circuits can be reversed in that the first leg of channel can be arranged along the suction side wall and the third leg or channel arranged along the pressure side wall. For example, the suction side wall just downstream from the gill hole (if used) is also a hot section on the airfoil that can be hotter than other sections on the pressure side wall. This surface on the suction side wall would require more cooling. Thus, the coolest temperature air would be used to provide cooling to this section.

I claim the following:

1. A turbine rotor blade for use in a gas turbine engine, the turbine blade comprising:

an airfoil having a pressure side wall and a suction side wall;

a plurality of 3-pass serpentine flow near wall cooling circuits to provide near wall cooling for the pressure side wall and the suction side wall of the airfoil;

the plurality of 3-pass serpentine flow near wall cooling circuits each including a radial extending near wall cooling channel on the pressure side wall, a radial extending near wall cooling channel on the suction side wall, and a collection cavity connected to the two radial extending near wall cooling channels and located in-between them; and, the plurality of 3-pass serpentine flow near wall cooling circuits including a first leg located on the pressure side wall.

2. The turbine rotor blade of claim 1, and further comprising:

the 3-pass serpentine flow near wall cooling circuits extends along substantially the entire spanwise length of the airfoil.

3. The turbine rotor blade of claim 1, and further comprising:

the radial extending near wall cooling channels both have flow direction toward a blade tip.

4. The turbine rotor blade of claim 1, and further comprising:

the radial extending near wall cooling channels have trip strips on the walls exposed to a hot gas flow; and, the collection cavities have no trip strips.

5. The turbine rotor blade of claim 1, and further comprising:

the collection cavity is around twice the flow area as the two radial extending near wall cooling channels.

6. The turbine rotor blade of claim 1, and further comprising:

the radial extending near wall cooling channels do not have any film cooling holes connected to them to discharge cooling air from the channel.

7. The turbine rotor blade of claim 1, and further comprising:

the third leg of the 3-pass serpentine flow cooling circuit includes a blade tip cooling hole to discharge cooling air from the channel.

8. The turbine rotor blade of claim 1, and further comprising:

the plurality of 3-pass serpentine flow near wall cooling circuits form separate cooling air circuits within the airfoil.

9. The turbine rotor blade of claim 1, and further comprising:

the blade includes a leading edge cooling air supply channel and a leading edge impingement cavity connected through a row of metering and impingement holes;

a showerhead arrangement of film cooling holes connected to the leading edge impingement cavity;

a trailing edge cooling air supply channel connected to multiple impingement holes formed within the trailing edge region of the airfoil;

a row of exit cooling slots connected to the impingement cooling holes; and, the plurality of 3-pass serpentine flow near wall cooling circuits extend between the leading edge cooling supply channel and the trailing edge cooling air supply channel.

10. The turbine rotor blade of claim 1, and further comprising:

a hot section on the suction side wall includes a suction side radial extending near wall cooling channel that forms a first leg for the 3-pass serpentine flow cooling circuit that provides near wall cooling for the suction side wall hot section.

11. A turbine rotor blade for use in a gas turbine engine, the turbine blade comprising:

an airfoil having a pressure side wall and a suction side wall;

a three-pass serpentine flow cooling circuit having a first leg, a second leg and a third leg formed within the blade;

the first leg being a radial extending near wall cooling channel on a first hot wall surface of the airfoil and having a cooling air flowing direction toward a blade tip;

the third leg being a radial extending near wall cooling channel on a second hot wall surface of the airfoil opposite to the first hot wall surface and having a cooling air flowing direction toward a blade tip;

the first and second legs having trip strips on the walls exposed to a hot gas flow;

the second leg being a collection cavity with a cooling air flowing direction toward a blade root; and, the collection cavity having a larger cross sectional flow area than the first and third legs such that flow restriction is minimized.

12. The turbine rotor blade of claim 11, and further comprising:

the first and second legs do not have any film cooling holes connected to them to discharge cooling air from the channel.

13. The turbine rotor blade of claim 11, and further comprising:

the third leg includes a blade tip cooling hole to discharge cooling air from the channel.

14. The turbine rotor blade of claim 11, and further comprising:

the first leg is located along the pressure side wall; and, the third leg is located along the suction side wall.

* * * * *

UNITED STATES PATENT AND TRADEMARK OFFICE

CERTIFICATE OF CORRECTION

PATENT NO. : 8,061,990 B1
APPLICATION NO. : 12/404049
DATED : November 22, 2011
INVENTOR(S) : John E. Ryznic It is certified that error appears in the above-identified patent and that said Letters Patent is hereby corrected as shown below:

In the Claims

Column 6, lines 3-4 (Claim 11, lines 14-15) that recites "the first and second legs having trips strips on the walls exposed to a hot gas flow;" should recite "the first and third legs having trips strips on the walls exposed to a hot gas flow;".

Signed and Sealed this
Sixth Day of August, 2013

Teresa Stanek Rea
*Acting Director of the United States Patent and Trademark Office*